US009310143B2

(12) United States Patent
Valente

(10) Patent No.: US 9,310,143 B2
(45) Date of Patent: Apr. 12, 2016

(54) HEAT EXCHANGE DEVICE WITH IMPROVED SYSTEM FOR DISTRIBUTING COOLANT FLUID

(75) Inventor: Piero Valente, Cologna Veneta (IT)

(73) Assignee: ALFA LAVAL CORPORATE AB, Lund (SE)

( * ) Notice: Subject to any disclaimer, the term of this patent is extended or adjusted under 35 U.S.C. 154(b) by 467 days.

(21) Appl. No.: 13/810,071

(22) PCT Filed: Jul. 7, 2011

(86) PCT No.: PCT/EP2011/061505

§ 371 (c)(1),
(2), (4) Date: Jan. 14, 2013

(87) PCT Pub. No.: WO2012/007344

PCT Pub. Date: Jan. 19, 2012

(65) Prior Publication Data

US 2013/0112381 A1 May 9, 2013

(30) Foreign Application Priority Data

Jul. 16, 2010 (IT) ..... MI20100249 U

(51) Int. Cl.
*F28D 7/00* (2006.01)
*F28F 9/22* (2006.01)
(Continued)

(52) U.S. Cl.
CPC ..... *F28F 13/06* (2013.01); *F28D 7/103* (2013.01); *F28D 7/16* (2013.01); *F28F 9/0278* (2013.01)

(58) Field of Classification Search
CPC ... F28D 1/0213; F28D 7/103; F28D 1/05316; F28F 13/003; F28F 9/268; F28F 9/26; F28F 9/0278; F28F 9/0265; F28F 9/0219; F28F 13/06
USPC ..... 165/158, 157, 146, 159, 174
See application file for complete search history.

(56) References Cited

U.S. PATENT DOCUMENTS 2,602,647 A * 7/1952 Miller ..... 165/109.1
3,407,875 A * 10/1968 Campbell ..... 165/174
(Continued)

FOREIGN PATENT DOCUMENTS

JP 9-061071 A 3/1997
JP 2000-008477 A 3/2000
(Continued)

OTHER PUBLICATIONS

International Search Report (PCT/ISA/210) issued on Feb. 8, 2012, by the European Patent Office as the International Searching Authority for International Application No. PCT/EP2011/061505.
(Continued)

*Primary Examiner* — Allen Flanigan
*Assistant Examiner* — Jason Thompson
(74) *Attorney, Agent, or Firm* — Buchanan Ingersoll & Rooney PC

(57) ABSTRACT

A heat exchange device comprises plural tubes arranged parallel to one another to form one or more tube bundles inserted axially in a cylindrical shell. A first fluid supplied through one or more first inlet holes at a first end of the cylindrical shell and oriented axially, flows inside the tubes and a second fluid, supplied through a second inlet hole, flows inside the cylindrical shell to effect heat transfer with the first fluid through the tube walls. One end of the tubes is connected to a tube plate at first inlet hole(s), which separates the second fluid from the first fluid. At least two impingement plates, each provided with plural through holes, are placed in succession between each first inlet hole and the tube plate. The impingement plates are parallel to one another and orthogonal to the cylindrical shell central axis to distribute the first fluid inside the tubes.

11 Claims, 6 Drawing Sheets

(51) Int. Cl.

| | |
|---|---|
| ***F28D 9/02*** | (2006.01) |
| ***F28F 13/00*** | (2006.01) |
| ***F28F 9/02*** | (2006.01) |
| ***F28F 13/06*** | (2006.01) |
| ***F28D 7/16*** | (2006.01) |
| ***F28D 7/10*** | (2006.01) |

(56) References Cited

U.S. PATENT DOCUMENTS

| | | | | |
|---|---|---|---|---|
| 3,982,900 | A | 9/1976 | Malgarini et al. | |
| 4,390,997 | A * | 7/1983 | Hinz et al. | 2/81 |
| 4,576,222 | A | 3/1986 | Granata, Jr. et al. | |
| 4,614,229 | A | 9/1986 | Oldweiler | |
| 4,645,001 | A | 2/1987 | Hillerström | |
| 5,261,485 | A * | 11/1993 | Thornton et al. | 165/174 |
| 6,537,419 | B1 | 3/2003 | Kinnard | |
| 6,830,099 | B2 | 12/2004 | Moeykens | |
| 6,868,695 | B1 | 3/2005 | Dingel et al. | |
| 7,600,386 | B2 * | 10/2009 | Saito et al. | 62/6 |
| 2001/0017202 | A1 | 8/2001 | Mitsumoto et al. | |
| 2002/0179294 | A1 * | 12/2002 | Gupte | 165/159 |
| 2007/0119191 | A1 | 5/2007 | Saito et al. | |
| 2007/0151279 | A1 | 7/2007 | Liu et al. | |
| 2007/0235173 | A1 * | 10/2007 | Chen | 165/159 |
| 2008/0023185 | A1 * | 1/2008 | Beamer et al. | 165/174 |
| 2009/0000775 | A1 * | 1/2009 | Al-Hadhrami | 165/134.1 |
| 2009/0165722 | A1 | 7/2009 | Ha | |
| 2009/0242178 | A1 | 10/2009 | Al-Anizi et al. | |
| 2010/0006031 | A1 | 1/2010 | Choi et al. | |
| 2010/0206535 | A1 | 8/2010 | Munoz et al. | |

FOREIGN PATENT DOCUMENTS

| | | | |
|---|---|---|---|
| WO | WO 02/090860 | A1 | 11/2002 |
| WO | WO 2009/048451 | A1 | 4/2009 |

OTHER PUBLICATIONS

Written Opinion (PCT/ISA/237) issued on Feb. 8, 2012, by the Patent Office as the International Searching Authority for International Application No. PCT/EP2011/061505.

* cited by examiner

HEAT EXCHANGE DEVICE WITH IMPROVED SYSTEM FOR DISTRIBUTING COOLANT FLUID

The present invention refers to a heat exchange device with an improved system for the distribution of coolant fluid.

As it is known, in a heat exchange device there is the exchange of heat energy between two fluids at different temperatures. In general, the heat exchange devices are open systems that operate without work exchange, i.e. they have constant flow of fluid and a constant temperature distribution in normal operating conditions.

Amongst the various types of heat exchange devices so called "shell and tube heat exchangers" are included. Shell and tube heat exchangers are widely used in industrial applications, in cooling systems, in air conditioning systems and, in general, in all those applications in which high pressure fluids are treated. The advantages of this type of heat exchange device foresee amongst other things:

the presence of large surface areas inside a relatively small overall volume;

good mechanical strength so as to be able to operate in high pressure conditions;

the use of well-established construction techniques;

the possibility of being constructed with a considerable number of different materials, like for example anti-corrosion alloys;

ease of cleaning.

Essentially, a tube bundle heat exchange device consists of a group of tubes inserted inside a cylindrical body called "shell". One of the fluids, typically the coolant fluid, flows inside the tubes of the tube bundle, whereas the other fluid, typically the fluid to be cooled down, flows, on the other hand, inside the shell and flows on the outer walls of the tubes. The heat is thus transferred from one fluid to the other through the walls of the tubes.

The opposite ends of the tubes are connected to plates which make it possible to separate the fluid that flows inside the shell from that which flows inside the tubes of the tube bundle. Inside the shell one or more division walls can be arranged, the functions of which are to direct the flow of the fluid on the side of the shell, increasing its speed, and to support the tubes of the tube bundle.

The fluids can be in liquid state, in gaseous state, and can be a two-phase liquid/vapour mixture. In order to transfer heat in the most efficient way possible, it is necessary for there to be a large heat exchange surface: consequently, it is advantageous to make shell and tube heat exchangers provided with a high number of tubes in the tube bundle itself.

An uneven distribution of the coolant fluid, normally made up of a two-phase liquid/vapour mixture, in inlet inside the tubes of the heat exchange device can negatively affect the overall efficiency and performance of the heat exchange device itself. The coolant fluid is configured so as to evaporate inside the tubes. If some of the tubes of the tube bundle are supplied with a two-phase mixture that has too much of the liquid component, there can be the risk of dripping at the outlet of the tubes themselves. Vice versa, if some of the tubes of the tube bundle are supplied with a two-phase mixture that has too much vapour there is, in outlet from the tubes themselves, a value of overheating that is too high. In both cases the heat exchange coefficient, that is to say the quantity of heat exchanged, is smaller with respect to an optimal condition, in which all the tubes of the heat exchange device are supplied with a two-phase mixture in which the distribution between the liquid component and the vapour component is even. The reduction of the heat exchange due to the aforementioned drawbacks also increases as the number of tubes in the tube bundle of the heat exchange device increases.

One of the current systems for the distribution of the coolant fluid inside a shell and tube heat exchange device foresees the presence of a so-called impingement plate or pan, indicated with reference numeral A in the attached FIG. 1. This is a plate positioned at the inlet hole of the coolant fluid, oriented in a substantially perpendicular manner with respect to the direction of the entering flow of such a coolant fluid. The function of the impingement plate is essentially that of intercepting the flow of coolant fluid in inlet to the heat exchange device so as to vary its direction, from parallel to substantially perpendicular to the direction of development of the tubes of the tube bundle. In such a way it is possible to obtain a better supply of coolant fluid inside the tubes, in particular those arranged in the peripheral areas of the tube bundle. On the other hand, the impingement plate can compromise the correct supply of the tubes located in the central area of the tube bundle, that is to say those located straight in front of the impingement plate itself.

The general purpose of the present invention is therefore that of making a heat exchange device with an improved system for distributing coolant fluid that is capable of solving the aforementioned drawbacks of the prior art in an extremely simple, cost-effective and particularly functional manner.

In detail, one purpose of the present invention is that of making a heat exchange device with an improved system for distributing coolant fluid that is capable of ensuring excellent results in terms of even distribution of the coolant fluid in the tubes of the tube bundle.

Another purpose of the invention is that of making a heat exchange device with an improved system for distributing coolant fluid that is versatile and that can be adapted to the heat exchange characteristics which are desired to be obtained with the device.

These purposes according to the present invention are achieved by making a heat exchange device with an improved system for distributing coolant fluid as outlined in claim 1.

Further characteristics of the invention are highlighted by the dependent claims, which are an integrating part of the present description.

The characteristics and the advantages of a heat exchange device with an improved system for distributing coolant fluid according to the present invention shall become clearer from the following description, given as an example and not for limiting purposes, with reference to the attached schematic drawings in which.

Figure 1:
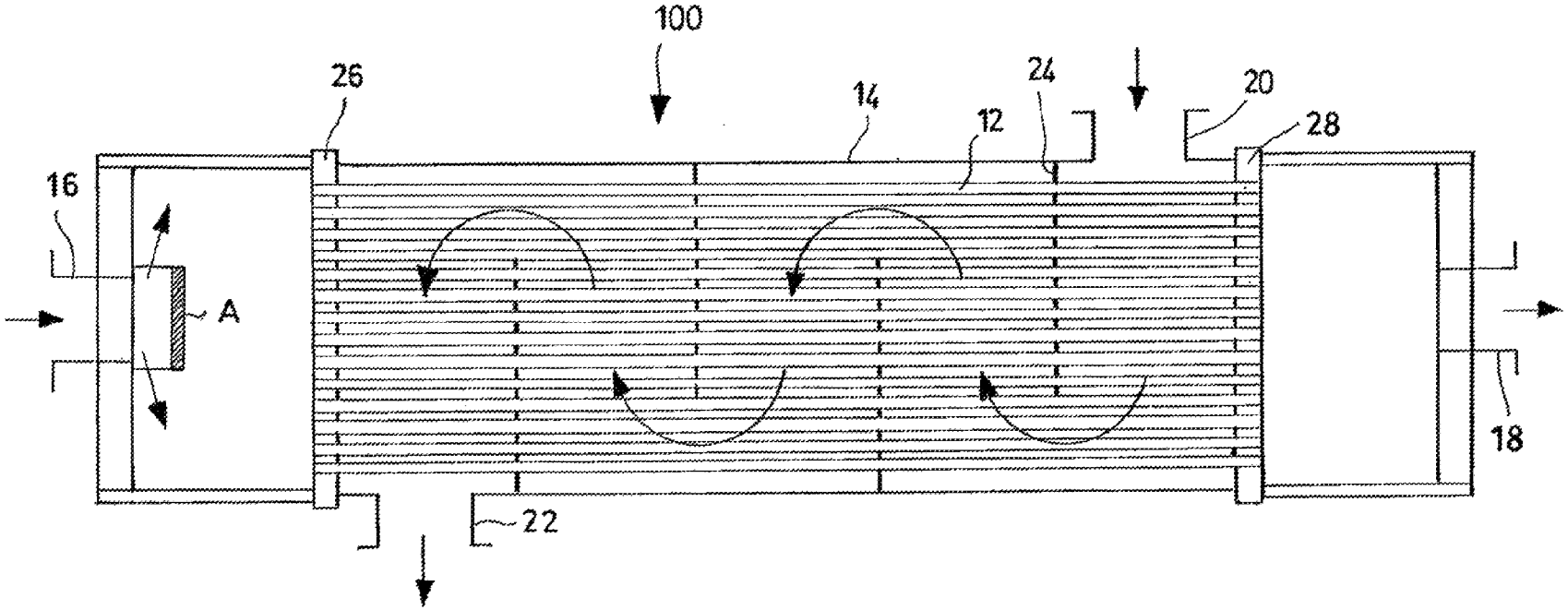
Fig.1 PRIOR ART
FIG. 1 is a schematic view that shows the flow of coolant fluid in a heat exchange device, of the shell and tube type, made according to the prior art.

It should be made clear, in the different attached figures, that same reference numerals indicate same or equivalent elements. It should also be made clear that, in the following description, numerous components of the heat exchange device shall not be mentioned, since they are components that are well known to a man skilled in the art.

Figure 2:
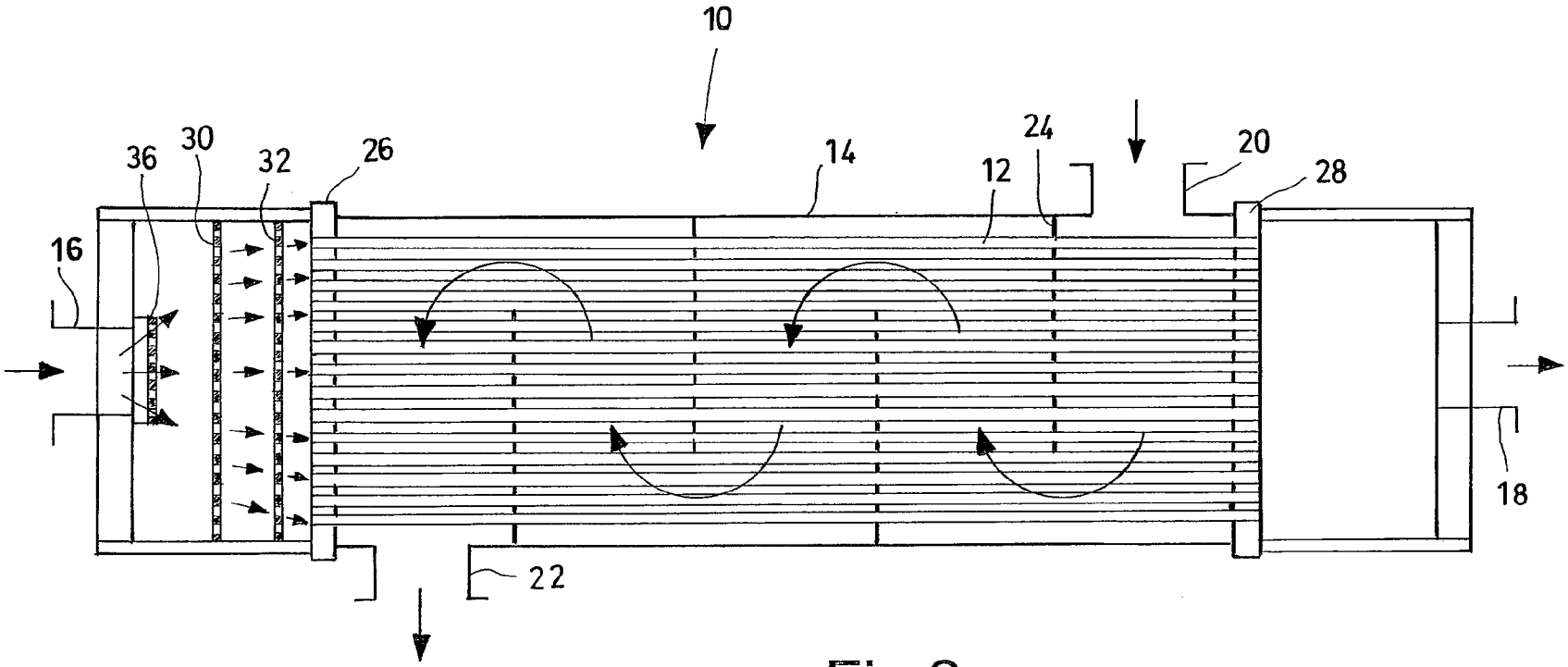
FIG. 2 is a schematic view showing the flow of coolant fluid in a heat exchange device, of the shell and tube type, made according to the present invention.

With reference in particular to FIG. 2, a heat exchange device made according to the present invention is shown in a completely schematic manner, wholly indicated with reference numeral 10. The heat exchange device 10, or more simply heat exchanger, is of the shell and tube type and generally has the same base characteristics of the heat exchange device 100 of the known type shown in FIG. 1. The heat exchange device indeed comprises a plurality of tubes 12 arranged parallel to one another in order to form one or more tube bundles. The tubes 12 are inserted axially in a cylindrical shell 14 which forms the tubesheet of the heat exchange device 10.

A first fluid, supplied through one or more first inlet holes 16, located at a first end of the cylindrical shell 14 and oriented axially, is capable of flowing inside the tubes 12 of the tube bundle and is discharged through a first outlet hole 18, located at the opposite end of the cylindrical shell 14 and oriented axially. A second fluid, supplied through a second inlet hole 20, typically located on the circumferential surface of the cylindrical shell 14, flows, on the other hand, inside the cylindrical shell 14 itself and flows on the outer walls of the tubes 12. The second fluid is discharged through a second outlet hole 22, also arranged on the circumferential surface of the cylindrical shell 14. The heat transfer between the first fluid and the second fluid thus occurs through the walls of the tubes 12. The first fluid, that is to say the fluid that flows inside the tubes 12, is normally a coolant fluid made up of a two-phase liquid/vapour mixture.

Inside the cylindrical shell 14 one or more division walls 24 can be formed, preferably arranged perpendicularly with respect to the central axis of the cylindrical shell 14 itself. The function of such division walls 24 is both that of directing the flow of the second fluid, increasing its speed, and that of supporting the tubes 12 of the tube bundle.

The opposite ends of the tubes 12 of the tube bundle are respectively connected to a first tube plate 26, arranged at the first inlet hole 16, and to a second tube plate 28, arranged at the first outlet hole 18. The tube plates 26 and 28 make it possible to separate the second fluid, that is to say the fluid that flows inside the cylindrical shell 14, from the first fluid, that is to say the two-phase fluid that flows inside the tubes 12 of the tube bundle.

According to the invention, between each first inlet hole 16 of the first fluid, or two-phase fluid, and the first tube plate 26 at least two impingement plates 30 and 32, each provided with a plurality of through holes 34, 34A, 34B and 34C are placed in succession. The impingement plates 30 and 32 are arranged parallel to one another and orthogonally with respect to the central axis of the cylindrical shell 14, and their function is to distribute in the most uniform way possible the two-phase fluid, entering through the inlet hole/s 16, inside the tubes 12 of the tube bundle.

Figure 3:
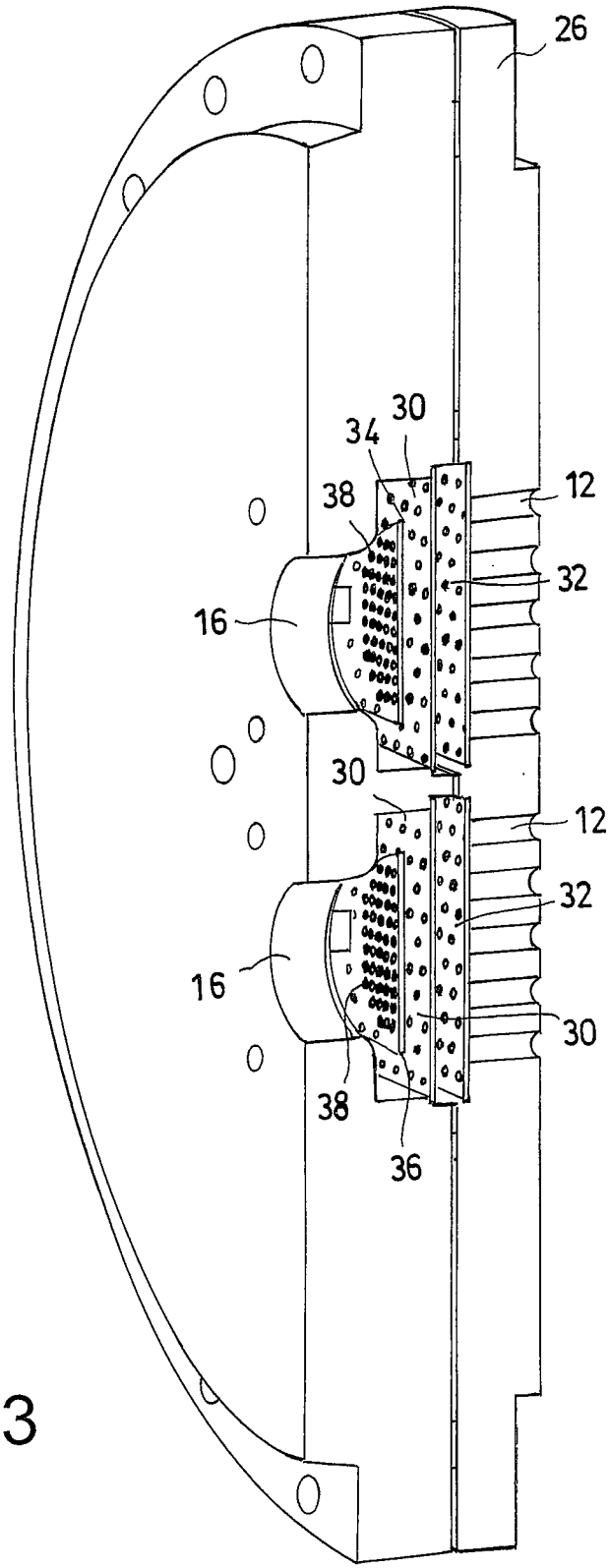
FIG. 3 is a perspective view, partially in section, of the end plate of the heat exchange device of FIG. 2.
Figure 4:
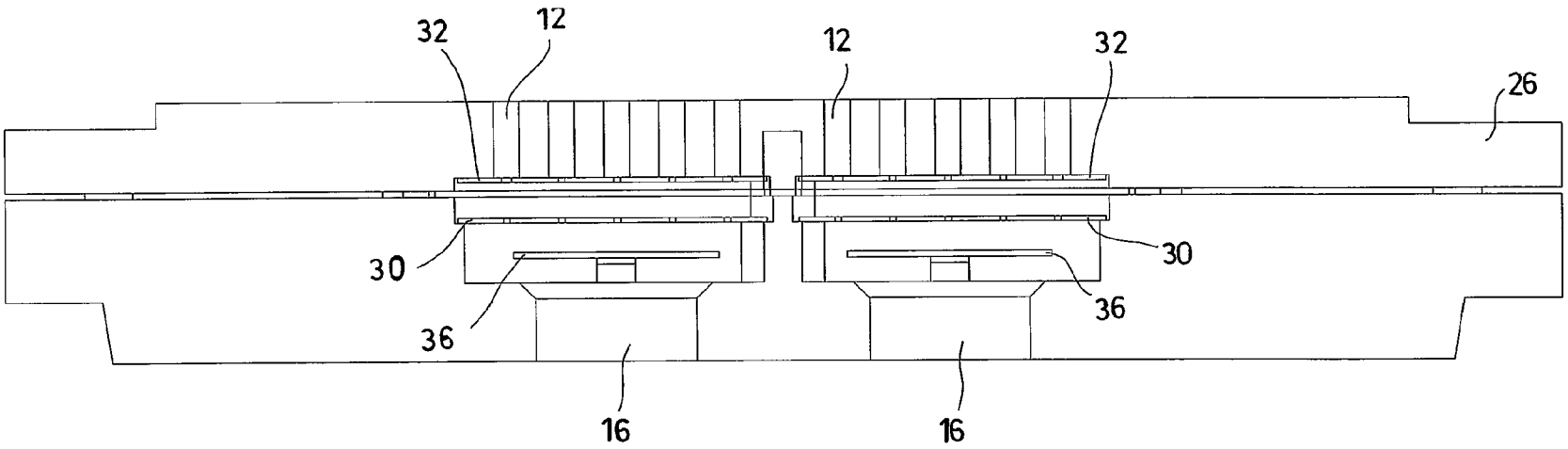
FIG. 4 is a cross-section view of the end plate of FIG. 3.

The number of through holes 34, 34A, 34B and 34C provided on at least one of the impingement plates 30 and 32 is preferably equal to the number of tubes 12 forming each single tube bundle. In addition, each impingement plate 30 and 32 is arranged at the central axis of each tube bundle. In FIGS. 3 and 4 the head of a heat exchange device 10 is indeed shown, in which two distinct inlet holes 16 for the two-phase fluid and in which the first tube plate 26 is configured so as to support two distinct tube bundles provided with tubes 12 that are parallel to one another, are formed. Consequently, two distinct pairs of impingement plates 30 and 32, each positioned at a single inlet hole 16 and at a single tube bundle, are foreseen.

Figure 5:
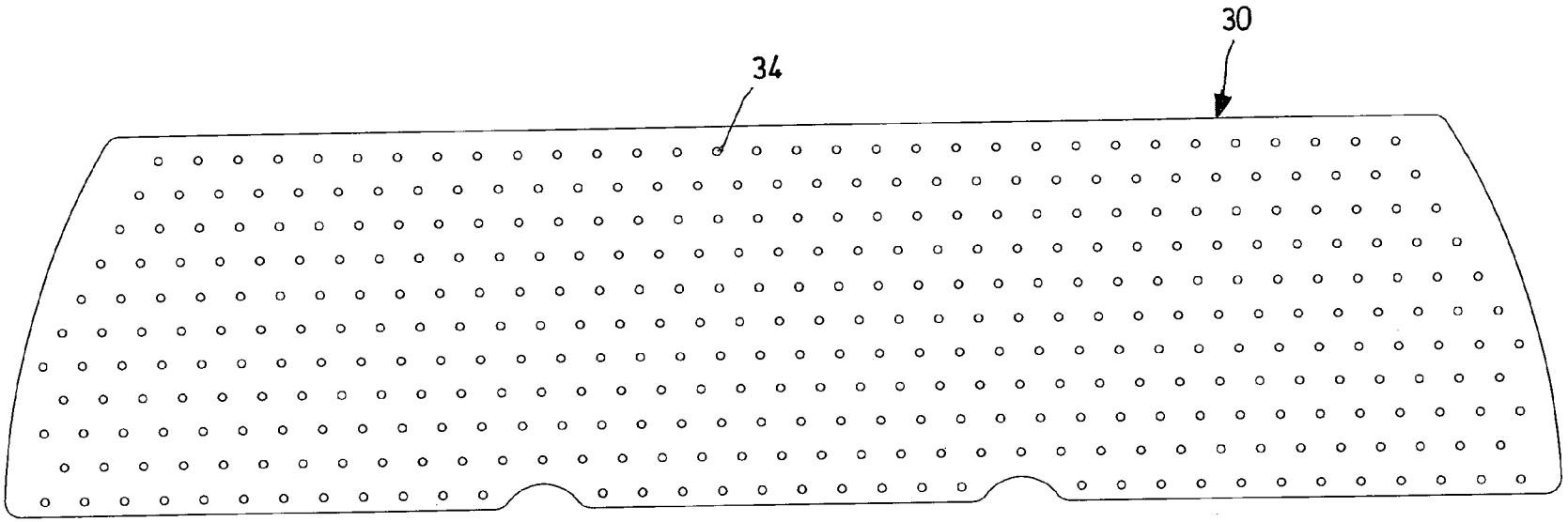
FIG. 5 is a top plan view of a component of the system for distributing coolant fluid of the heat exchange device of FIG. 2.

Preferably, a first of at least two impingement plates 30 and 32, that is to say the impingement plate 30 placed most upwards from the first inlet hole 16 and therefore nearest to the first inlet hole 16 itself, is provided with through holes 34 all having the same diameter, for example equal to about 2 mm. Such a first impingement plate 30 can thus be defined as a "symmetrical impingement plate" (FIG. 5).

Figure 6:
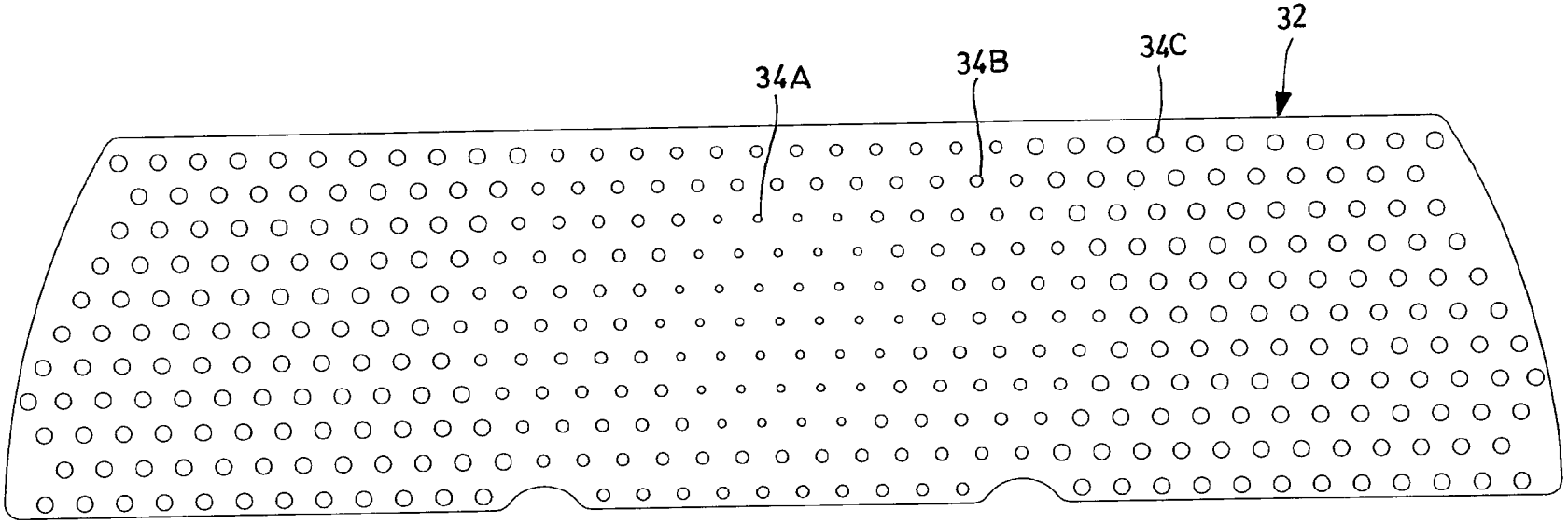
FIG. 6 is a top plan view of another component of the system for distributing coolant fluid of the heat exchange device of FIG. 2.

A second of the at least two impingement plates 30 and 32, that is to say the impingement plate 32 placed most downwards from the first inlet hole 16 and therefore nearest to the first tube plate 26, is on the other hand provided with two or more distinct groups of through holes 34A, 34B and 34C having diameters that are different from each other. Such a second impingement plate 32 can thus be defined as an "asymmetrical impingement plate" (FIG. 6). For example, the second impingement plate 32 can comprise a first group of through holes 34A with a small diameter, placed in the central portion of the second impingement plate 32 itself at the area that is run over by the flow of the first fluid supplied through the first inlet hole 16. The second impingement plate 32 can thus comprise one or more further groups of through holes 34B and 34C having a diameter that is greater than the diameter of the through holes 34A of the first group and that grow progressively from the centre towards the peripheral edge of the second impingement plate 32 itself. In fact, FIG. 6, purely as an example, shows a first group of central through holes 34A with a diameter of about 2 mm, a second group of intermediate through holes 34B having a diameter of about 3 mm and a third group of peripheral through holes 34C having a diameter of about 4 mm.

Typically the number of through holes 34A, 34B and 34C of the second impingement plate 32, that is to say the "asymmetrical impingement plate", is equal to the number of tubes 12 forming each single tube bundle. On the first impingement plate 30, that is to say the "symmetrical impingement plate", the number of through holes 34 is not, on the other hand, necessarily equal to that of the tubes 12: in practice, the number of through holes 34 of the first impingement plate 30 can be greater, smaller, and the same with respect to the number of tubes 12.

The distance, measured in the axial direction of the cylindrical shell 14, between the impingement plates 30 and 32 can be adjusted according to the heat exchange characteristics that are desired to be obtained by the heat exchange device 10. According to tests carried out by the applicant, such a distance can be in the order of a few millimeters and, on an operating prototype of a heat exchange device provided with impingement plates 30 and 32 having through holes with the aforementioned diameter, can be fixed at about 10 mm.

Finally it can be foreseen for there to be, in addition to the at least two impingement plates 30 and 32 described thus far, a further perforated impingement pan 36, placed upwards with respect to the two impingement plates 30 and 32 at the first inlet hole 16. As shown in FIG. 3, such a perforated impingement pan 36 is preferably provided with a plurality of through holes 38 having a suitable diameter in relation to the operating conditions of the heat exchange device 10. In addition, such a perforated impingement pan 36 is preferably provided with an overall surface that is smaller than the global surface of the two impingement plates 30 and 32, so as to allow the passage of the two-phase fluid not only through the through holes 38 which it is provided with, but also around its perimeter edge.

It has thus been seen that the heat exchange device with an improved system for distributing coolant fluid according to the present invention achieves the aforementioned purposes. The presence of numerous perforated pans, having holes with a variable diameter and with the possibility of adjusting their distance apart, makes it possible for the distributing system to be adapted to every operative requirement and especially makes it possible to obtain a distribution of coolant fluid in the tubes of the tube bundle which is as even as possible.

The heat exchange device with an improved system for distributing coolant fluid according to the present invention thus conceived can in any case undergo numerous modifications and variants, all covered by the same inventive concept; moreover, all the details can be replaced by technically equivalent elements. In practice the materials used, as well as the shapes and sizes, can be any according to the technical requirements.

The scope of protection of the invention is thus defined by the attached claims.

The invention claimed is:

1. Heat exchange device comprising a plurality of tubes arranged parallel one to the other in order to form one or more tube bundles inserted axially in a cylindrical shell, a first fluid, supplied through one or more first inlet holes located at a first end of the cylindrical shell and oriented axially, flowing inside the tubes and a second fluid, supplied through a second inlet hole, flowing inside said cylindrical shell in order to carry out heat transfer with the first fluid through the walls of the tubes, a first end of the tubes being connected to a tube plate located at said one or more first inlet holes, separating the second fluid from the first fluid, wherein between the one or more first inlet holes of the first fluid and the tube plate at least two impingement plates are placed in succession, each of the impingement plates provided with a plurality of through holes, said impingement plates being disposed parallel one to the other and orthogonally as regards the central axis of the cylindrical shell to distribute in the most uniform way the first fluid inside the tubes, wherein the number of through holes provided on at least one of said impingement plates is equal to the number of tubes forming the one or more tube bundles, and wherein a perforated impingement pan is between the one or more first inlet holes and the tube plate, the perforated impingement pan being upstream of one of the impingement plates, upstream of an other of the impingement plates, and downstream of the first inlet hole, the perforated impingement pan possessing an outer periphery that is spaced apart from an inlet manifold allowing the first fluid to flow around the outer periphery of the perforated impingement pan; and wherein the perforated impingement pan possesses a surface area, the surface area of the impingement pan being smaller than a surface area of the one impingement plate, and the surface area of the impingement pan being smaller than a surface area of the other impingement plate.

2. Heat exchange device according to claim 1, wherein each impingement plate is placed at the central axis of the one or more tube bundles.

3. Heat exchange device according to claim 1, wherein the one impingement plate is placed more upwards from the first inlet hole than the other impingement plate, and therefore is closer to said first inlet hole, and the one impingement plate is provided with through holes all having the same diameter.

4. Heat exchange device according to claim 1, wherein the other impingement plate is placed more downwards from the first inlet hole than the one impingement plate, and therefore is closer to the tube plate, and the other impingement plate is provided with two or more distinct groups of through holes having diameters different from each other.

5. Heat exchange device according to claim 4, wherein the other impingement plate comprises a first group of through holes with a reduced diameter, placed in a central portion of said other impingement plate at an area run over by the flow of the first fluid supplied through the first inlet hole, and one or more further groups of through holes having a greater diameter than the diameter of the through holes of said first group.

6. Heat exchange device according to claim 5, wherein the through hole diameter of said groups grows progressively from the centre towards a peripheral edge of the other impingement plate.

7. Heat exchange device according to claim 1, wherein the distance, measured in the axial direction of the cylindrical shell, between said at least two impingement plates is adjustable according to the heat exchange features that one want to obtain through the heat exchange device.

8. Heat exchange device according to claim 1, wherein the perforated impingement pan is provided with a plurality of through holes having a suitable diameter in relation to operating conditions of the heat exchange device.

9. Heat exchange device according to claim 1, wherein the first fluid is a coolant fluid made of a two-phase liquid/vapour mixture.

10. A heat exchange device comprising:

a cylindrical shell possessing an interior, a central axis, and a first end;

a plurality of parallel tubes positioned in the interior of the cylindrical shell and extending axially within the cylindrical shell, each of the tubes possessing a first end;

a first inlet hole located at the first end of the cylindrical shell and oriented axially, the first inlet hole communicating with the plurality of tubes to introduce a first fluid into the plurality of tubes by way of the first inlet hole;

a second inlet hole communicating with the interior of the cylindrical shell to introduce a second fluid into the interior of the cylindrical shell so that the second fluid carries out heat transfer with the first fluid through walls of the plurality of tubes;

a tube plate positioned to fluidly separate the interior of the cylindrical shell into one part communicating with the first inlet hole and a second part communicating with the second inlet hole, the first end of each of the tubes being connected to the tube plate;

a first impingement plate and a second impingement plate each comprising a plurality of through holes, the first impingement plate and the second impingement plate being spaced apart from one another;

the first impingement plate and the second impingement plate being positioned between the tube plate and the first inlet hole;

the first impingement plate and the second impingement plate being parallel to one another and orthogonal to the central axis of the cylindrical shell to uniformly distribute the first fluid into the tubes;

the first impingement plate and the second impingement plate possessing equivalent surface areas;

a perforated impingement pan upstream of the first impingement plate, upstream of the second impingement plate, and downstream of the first inlet hole, the perforated impingement pan possessing an outer periphery;

the outer periphery of the perforated impingement pan being spaced apart from an inlet manifold allowing the first fluid to flow around the outer periphery of the perforated impingement pan; and the perforated impingement pan possessing a smaller surface area than the first impingement plate and a smaller surface area than the second impingement plate.

11. The heat exchanging device according to claim 10, wherein the first impingement plate is spaced apart from the second impingement plate by 10 mm.

* * * * *